US012428861B2

(12) United States Patent
Routh et al.

(10) Patent No.: US 12,428,861 B2
(45) **Date of Patent: *Sep. 30, 2025**

(54) FILLER BEAM ASSEMBLY

(71) Applicant: PERI SE, Weissenhorn (DE)

(72) Inventors: Anibrata Routh, Mumbai (IN); K S. Arun, Mumbai (IN); CNVS Rao, Mumbai (IN); A Sharanappa, Mumbai (IN)

(73) Assignee: PERI SE, Weissenhorn (DE)

( * ) Notice: Subject to any disclaimer, the term of this patent is extended or adjusted under 35 U.S.C. 154(b) by 109 days.

This patent is subject to a terminal disclaimer.

(21) Appl. No.: 18/455,763

(22) Filed: Aug. 25, 2023

(65) Prior Publication Data

US 2023/0399860 A1 Dec. 14, 2023

Related U.S. Application Data

(63) Continuation of application No. 17/114,183, filed on Dec. 7, 2020, now Pat. No. 11,773,607.

(30) Foreign Application Priority Data

Dec. 7, 2019 (IN) ..... 201911050607

(51) Int. Cl.
*E04G 11/50* (2006.01)
*E04G 11/48* (2006.01)
(Continued)

(52) U.S. Cl.
CPC ..... *E04G 11/50* (2013.01); *E04G 11/48* (2013.01); *E04G 11/52* (2013.01); *E04G 11/56* (2013.01); *E04G 11/483* (2013.01)

(58) Field of Classification Search
CPC ..... E04G 11/38; E04G 11/48; E04G 11/50; E04G 11/52; E04G 11/56; E04G 11/483; E04G 11/486; E04G 2011/505
See application file for complete search history.

(56) References Cited

U.S. PATENT DOCUMENTS 1,888,738 A 11/1932 Roos
1,907,877 A 5/1933 Roos
(Continued)

FOREIGN PATENT DOCUMENTS

AU 4785668 6/1970
AU 425815 7/1972
(Continued)

OTHER PUBLICATIONS

"MevaDec Technical Instruction Manual", Jun. 2010, https://authorzilla.com/EaKa/mevadec-slab-formwork-technical-instruction-manual.html, 52 pages., Mar. 29, 2010.
(Continued)

*Primary Examiner* — Jessie T Fonseca
(74) *Attorney, Agent, or Firm* — SLEMAN & LUND LLP

(57) ABSTRACT

A filler beam assembly of a formwork structure is disclosed. The filler beam assembly includes a beam having a first end and a second end distal to the first end. The first end and the second end are adapted to be in contact with top plates of respective drop head assemblies. The beam includes a top surface having a drophead interface edge at the first end and a drophead interface edge at the second end. The filler beam assembly includes a first lip formed on one side of the beam and adapted to accommodate one of a timber runner and a PU insert for being nailed with a plywood positioned adjacent to the top surface of the beam, and an additional lip disposed below the first lip and adapted to be accommodate a head portion of a cross beam.

13 Claims, 11 Drawing Sheets

(51) Int. Cl.
*E04G 11/52* (2006.01)
*E04G 11/56* (2006.01)

(56) References Cited

U.S. PATENT DOCUMENTS

| | | | | |
|---|---|---|---|---|
| 4,156,999 | A | 6/1979 | Avery | |
| 5,718,092 | A | 2/1998 | Corston | |
| 8,262,056 | B2 * | 9/2012 | Schwoerer | E04G 11/483 249/210 |
| 10,053,875 | B1 * | 8/2018 | Baron | E04G 11/50 |
| 10,711,472 | B2 * | 7/2020 | Bond | E04G 11/38 |
| 2007/0200048 | A1 | 8/2007 | Edwards | |
| 2007/0261360 | A1 | 11/2007 | McCracken | |
| 2017/0275902 | A1 * | 9/2017 | Faresin | E04G 11/38 |
| 2019/0010717 | A1 * | 1/2019 | Baron | E04G 11/52 |
| 2019/0063086 | A1 | 2/2019 | Uribeetxebarria Zubia | |

FOREIGN PATENT DOCUMENTS

| | | | | |
|---|---|---|---|---|
| CA | 1038603 | | 9/1978 | |
| CA | 2416644 | A1 | 7/2004 | |
| CH | 660049 | A5 | 3/1987 | |
| DE | 801952 | C | 1/1951 | |
| DE | 840435 | C | 6/1952 | |
| DE | 19720885 | A1 | 11/1998 | |
| DE | 29918827 | U1 | 2/2000 | |
| DE | 19932707 | C1 | 2/2001 | |
| DE | 10035823 | A1 | 2/2002 | |
| DE | 10135664 | A1 | 2/2003 | |
| EP | 0345902 | A2 | 12/1989 | |
| EP | 1526226 | A1 | 4/2005 | |
| FR | 1243767 | A | 10/1960 | |
| GB | 520747 | A | 5/1940 | |
| GB | 2148976 | A | 6/1985 | |
| GB | 2265655 | A | 10/1993 | |
| KR | 20010054437 | A | 7/2001 | |
| KR | 200291492 | | 10/2002 | |
| KR | 20080084130 | A | 9/2008 | |
| KR | 101388823 | B1 | 4/2014 | |
| KR | 20180029144 | | 3/2018 | |
| WO | WO-2006100694 | A1 * | 9/2006 | E04G 11/486 |
| WO | 2012174597 | A1 | 12/2012 | |

OTHER PUBLICATIONS

Round Scaffolding Pty. Ltd., https://www.scribd.com/document/423038464/Green-formwork, Aug. 24, 2019.

* cited by examiner

400

500

700

FILLER BEAM ASSEMBLY

CROSS REFERENCE TO RELATED APPLICATIONS

This application claims priority to U.S. application Ser. No. 17/114,183, filed Dec. 7, 2020, which claims the benefit of IN 202911050607, filed Dec. 7, 2019, all of which are herein incorporated in their entirety.

FIELD OF THE INVENTION

The present disclosure relates to construction industry and more particularly, relates to filler beam assemblies for facilitating infill solutions.

BACKGROUND

In the construction industry, wall forms or panels are generally used as supporting components to form structures, such as columns, slabs, and walls. Such panels are usually made of wood having a metal frame or made entirely of metal. Based on dimensions and shape of a structure to be formed, multiple panels are installed at a construction site to form a hollow space which would correspond to the dimensions and shape of the structure.

In order to provide infill solutions around areas, such as columns and column capitals, filler beams are used along with slab formworks. Such filler beams usually have a provision for a timber or a Polyurethane (PU) insert to nail plywood. In order to facilitate such provisions, separate one or more components are connected with a filler beam. The fixing of the separate components allows for accommodation of the timber or the PU insert on the filler beam.

Further, a filler beam is usually supported on a drop-head or any support head assembly. The drop-head or support head assembly includes a top plate adapted to in contact with the filler beam. Generally, the drophead or support head top plates has edges that are adapted to be in contact with the filler beam in an assembled state. Therefore, plywood that is supported by the filler beam also has to be cut to adjust to the interface edges of the top plate. This would result in wastage of material as well as an increased operational cost. Moreover, considering that these operations are to be performed at a construction site, this would cause inconvenience to a user as well.

SUMMARY

This summary is provided to introduce a selection of concepts, in a simplified format, that are further described in the detailed description of the invention. This summary is neither intended to identify key or essential inventive concepts of the invention and nor is it intended for determining the scope of the invention.

In an embodiment of the present disclosure, a filler beam assembly of a formwork structure is disclosed. The filler beam assembly includes a beam comprising a first end and a second end distal to the first end. The first end and the second end are adapted to be in contact with top plates of respective drop head assemblies. The beam also includes a top surface having a drophead interface edge at the first end and a drophead interface edge at the second end. The filler beam assembly further includes a first lip formed on one side of the beam and adapted to accommodate one of a timber runner and a PU insert for being nailed with a plywood positioned adjacent to the top surface of the beam. The filler beam assembly includes an additional lip disposed below the first lip and adapted to accommodate a head portion of a cross beam.

In another embodiment of the present disclosure, a formwork structure is disclosed. The formwork structure includes a filler beam assembly having a beam comprising a first end and a second end distal to the first end, and a top surface having a drophead interface edge at the first end and at the second end. The filler beam also includes a first lip formed on one side of the beam and adapted to accommodate one of a timber runner and a PU Insert for being nailed with a plywood positioned adjacent to the top surface of the beam. The filler beam further includes an additional lip disposed below the first lip. The formwork structure includes a drop-head assembly having a top plate adapted to be in contact with one of the first end and the second end of the beam. The top plate includes an interface edge to be in contact with the respective edge of the filler beam. The filler beam edge is formed to complement the interface edge of the drophead top plate.

To further clarify the advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1:
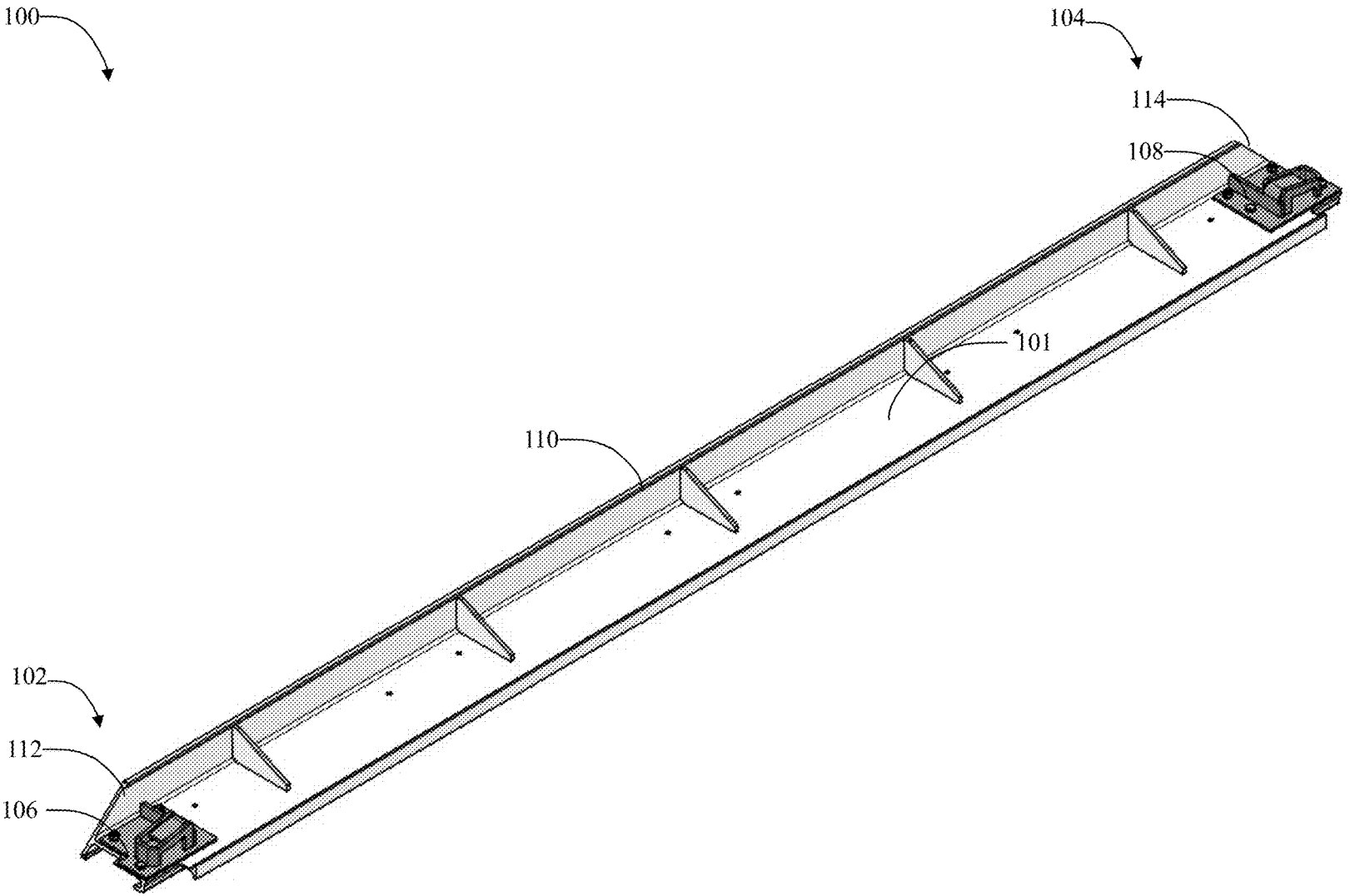
FIG. 1 illustrates a perspective view of a filler beam assembly, according to an embodiment of the present disclosure.

Further, skilled artisans will appreciate that elements in the drawings are illustrated for simplicity and may not have been necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF FIGURES

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The system, methods, and examples provided herein are illustrative only and not intended to be limiting.

For example, the term "some" as used herein may be understood as "none" or "one" or "more than one" or "all." Therefore, the terms "none," "one," "more than one," "more than one, but not all" or "all" would fall under the definition of "some." It should be appreciated by a person skilled in the art that the terminology and structure employed herein is for describing, teaching and illuminating some embodiments and their specific features and elements and therefore, should not be construed to limit, restrict or reduce the spirit and scope of the claims or their equivalents in any way.

For example, any terms used herein such as, "includes," "comprises," "has," "consists," and similar grammatical variants do not specify an exact limitation or restriction, and certainly do not exclude the possible addition of one or more features or elements, unless otherwise stated. Further, such terms must not be taken to exclude the possible removal of one or more of the listed features and elements, unless otherwise stated, for example, by using the limiting language including, but not limited to, "must comprise" or "needs to include."

Whether or not a certain feature or element was limited to being used only once, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language including, but not limited to, "there needs to be one or more . . . " or "one or more element is required."

Unless otherwise defined, all terms and especially any technical and/or scientific terms, used herein may be taken to have the same meaning as commonly understood by a person ordinarily skilled in the art.

Reference is made herein to some "embodiments." It should be understood that an embodiment is an example of a possible implementation of any features and/or elements presented in the attached claims. Some embodiments have been described for the purpose of explaining one or more of the potential ways in which the specific features and/or elements of the attached claims fulfil the requirements of uniqueness, utility, and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or other variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or in the context of more than one embodiment, or in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not necessarily be taken as limiting factors to the attached claims. The attached claims and their legal equivalents can be realized in the context of embodiments other than the ones used as illustrative examples in the description below.

Embodiments of the present invention will be described below in detail with reference to the accompanying drawings.

For the sake of clarity, the first digit of a reference numeral of each component of the present disclosure is indicative of the Figure number, in which the corresponding component is shown. For example, reference numerals starting with digit "1" are shown at least in FIG. 1. Similarly, reference numerals starting with digit "2" are shown at least in FIG. 2.

Figure 2:
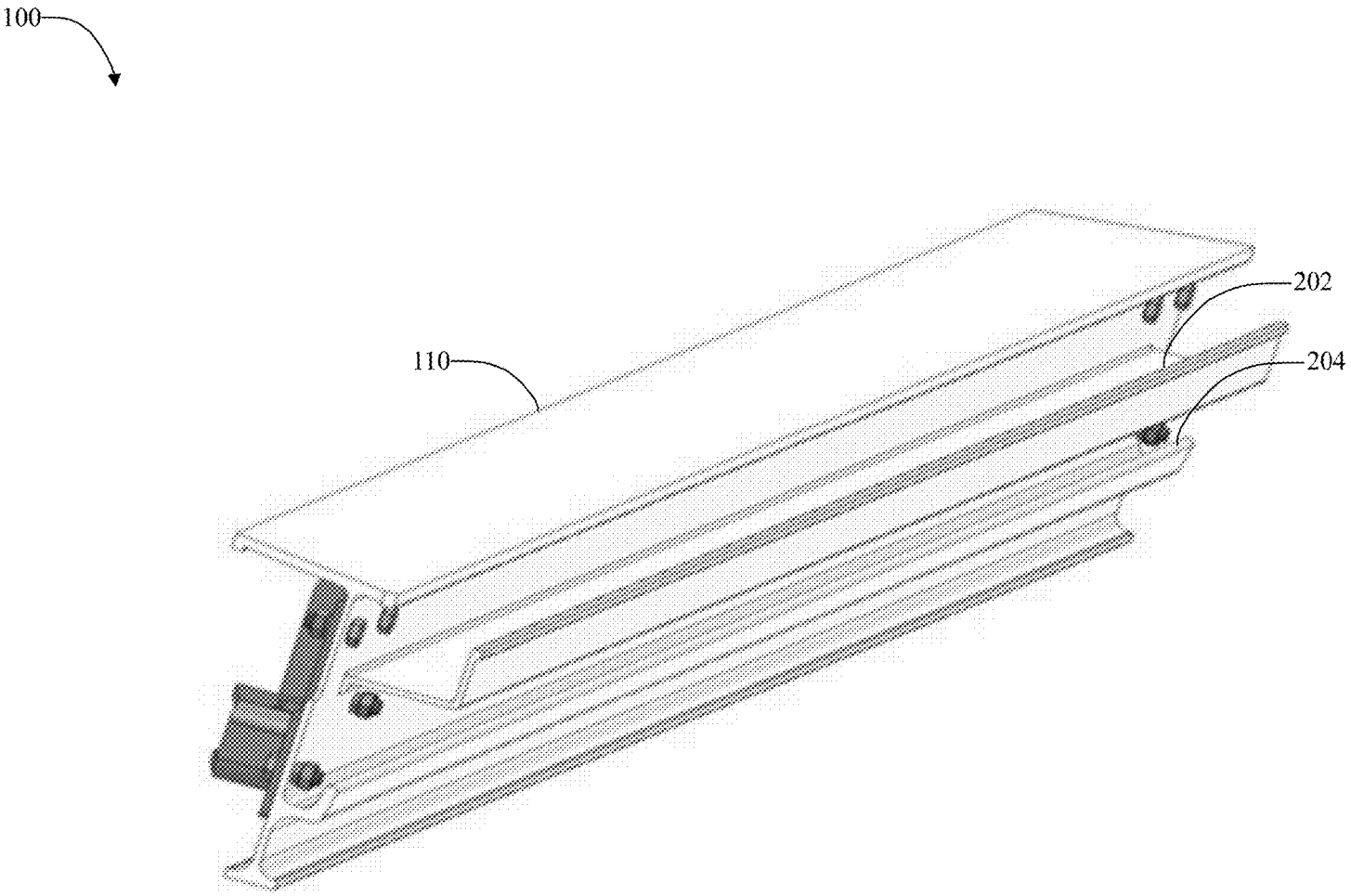
FIG. 2 illustrates another perspective view of the filler beam assembly, according to an embodiment of the present disclosure.
Figure 3:
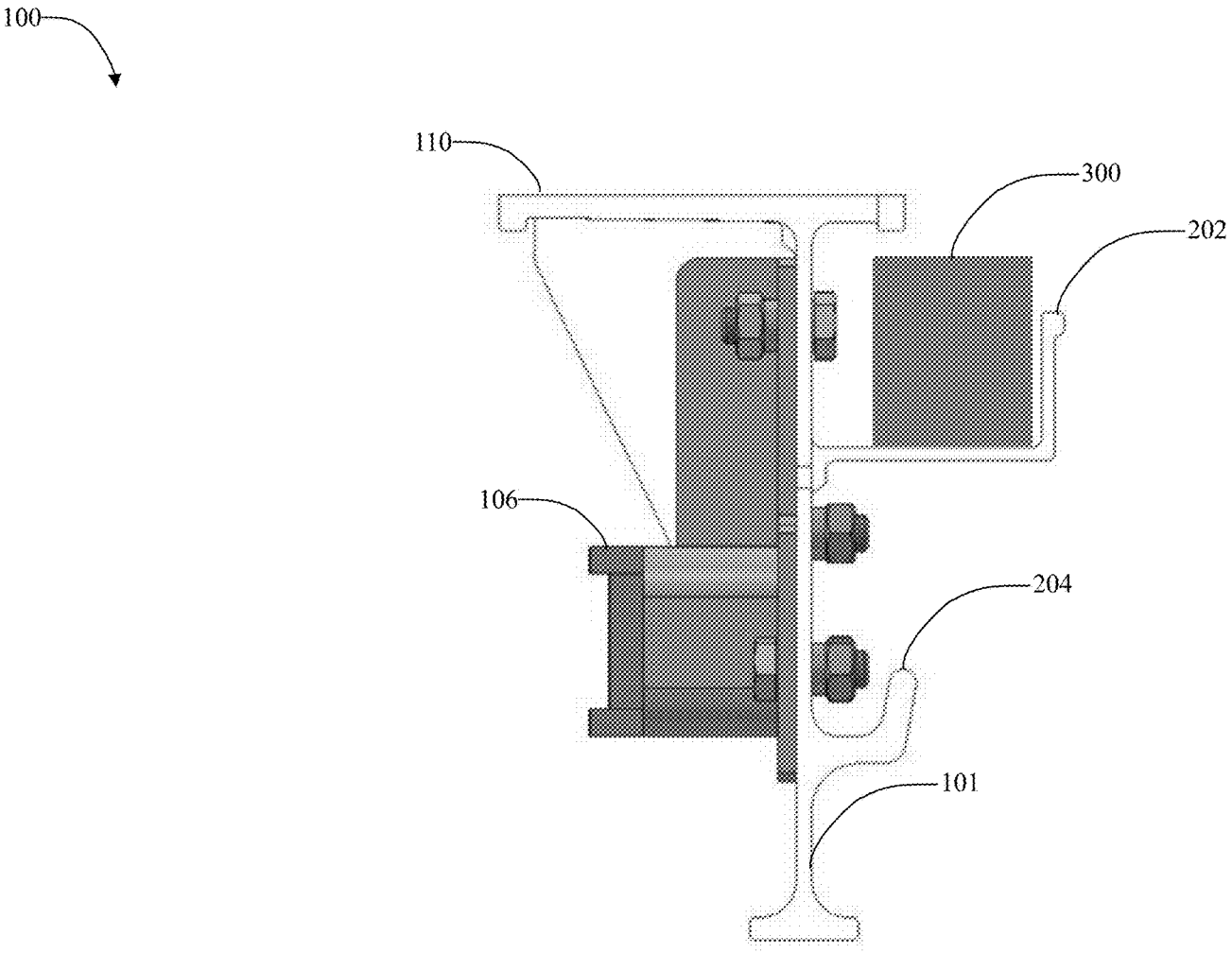
FIG. 3 illustrates a cross-sectional view of the filler beam assembly, according to an embodiment of the present disclosure.

FIG. 1 illustrates a perspective view of a filler beam assembly 100, according to an embodiment of the present disclosure. FIG. 2 illustrates another perspective view of the filler beam assembly 100, according to an embodiment of the present disclosure. FIG. 3 illustrates a cross-sectional view of the filler beam assembly 100, according to an embodiment of the present disclosure. In order to avoid duplicity of information, FIG. 1, FIG. 2, and FIG. 3 are explained in conjunction with each other.

Although the present disclosure is explained with respect to application of the filler beam assembly 100 in the field of construction, the application of the filler beam assembly 100 should not be construed to be limited to the construction industry only. In fact, the filler beam assembly 100 can be used in any other application, without departing from the scope of the present disclosure.

Referring to FIG. 1, FIG. 2, and FIG. 3, the filler beam assembly 100 may include a beam 101 having a first end 102 and a second end 104 distal to the first end 102. The first end 102 and the second end 104 are adapted to be in contact with top plates of respective drop head assemblies. In an embodiment, the beam 101 may be formed as an Aluminium extrusion of high-grade Aluminium alloy or made out of plate bent steel sections.

In an embodiment, the filler beam assembly 100 may also include a top surface 110 having a drophead interface edge at each end. Particularly, the top surface 110 may have a drophead interface edge 112 and a drophead interface edge 114 at the first end 102 and the second end 104, respectively. Each of the drophead interface edge 112 and the drophead interface edge 114 may be adapted to complement an interface edge of a top plate of a respective drop-head assembly.

In an embodiment, a plywood may be adapted to be positioned adjacent to the top surface 110. In an embodiment, the plywood having a thickness up to 26 mm may be supported on the beam 101. Owing to the drophead interface edges 112 and 114 of the top surface 110 of the beam 101, the plywood positioned adjacent to the top surface 110 does not need any cutting for accommodating the interface edge of the top plate of the drop-head assembly.

Further, in an embodiment, the filler beam assembly 100 may include a first lip 202 and an additional lip 204 disposed below the first lip 202. The first lip 202 and the additional lip 204 may be formed on one side of the beam 101. In an embodiment, the first lip 202 and the additional lip 204 may be formed along the length of the beam 101.

The first lip 202 may be adapted to accommodate one of a timber runner and a PU insert 300 for being nailed with the plywood positioned adjacent to the top surface 110 of the beam 101. The timber runner or PU insert 300 may be used to connect the filler beam assembly 100 with any other component. In an example, size of the timber runner or the PU insert 300 may vary depending on the thickness of the plywood. The shape or geometry of first lip 202 is designed to accommodate the timber or PU insert 300 of varying sizes so that the filler beam assembly 100 can be used with any plywood thicknesses ranging up to 26 mm. Further, the additional lip 204 may be adapted to accommodate a head portion of a cross beam for connecting with the cross beam. The details of the cross beam and the connection with the additional lip 204 are provided in the description of FIG. 4 and FIG. 5.

In an embodiment, in order to establish a connection with a drop head assembly, the filler beam assembly 100 may include a first end piece 106 and a second end piece 108 disposed adjacent to the first end 102 and the second end 104, respectively. The first end piece 106 and the second end piece 108 may be adapted to disposed on the other side of the beam 101, i.e., the side opposite to the side having the first lip 202 and the additional lip 204. In an embodiment, the first end piece 106 and the second end piece 108 are formed of steel. In another embodiment, the first end piece 106 and the second end piece 108 are formed of Aluminium.

In an embodiment, the first end piece 106 and the second end piece 108 may be fastened to the filler beam assembly 100 by a screw-nut mechanism. In other embodiments, the first end piece 106 and the second end piece 108 may be fastened to the filler beam assembly 100 through any other fastening mechanism, without departing from the scope of the present disclosure.

In an embodiment, the first end piece 106 and the second end piece 108 may be adapted to establish a connection with the respective drop head assemblies. In an embodiment, each of the first end piece 106 and the second end piece 108 may include a slot that is adapted to be fixed to a fly-plate pin of a respective drop-head assembly. The slots at the first end piece 106 and the second end piece 108 assists in easy hooking of the panels. The end pieces 106 and 108 are formed such that it prevents rotation and have the anti-tilting effect during shuttering. This construction helps in swinging the panels from bottom or if required even inserting from the top. The bolt connection of the end pieces 106 and 108 to the filler beam 101 prevents cross beam head to fall off at the edge.

Figure 4:
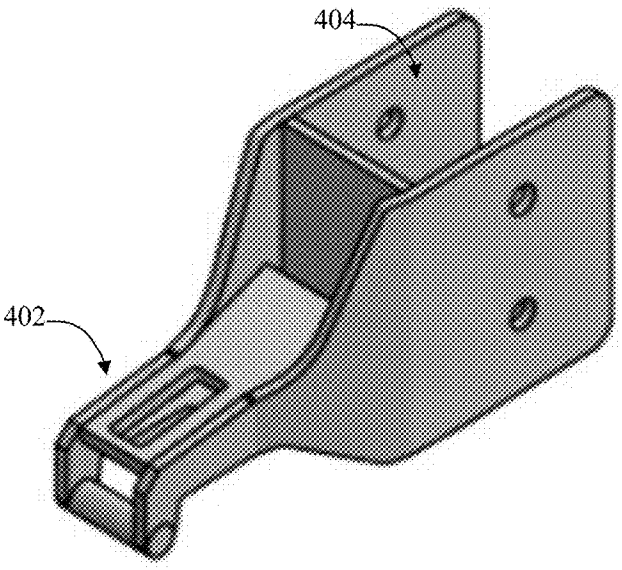
FIG. 4 illustrates a perspective view of a head portion of a cross beam, according to an embodiment of the present disclosure.

FIG. 4 illustrates a perspective view of the head portion 400 of the cross beam, according to an embodiment of the present disclosure. In an embodiment, the cross beam may be adapted to be coupled with the filler beam assembly 100 in order to facilitate column in-fills. Further, a cross beam may be formed of a timber runner or any other steel or aluminium member fixed to the head portion.

In an embodiment, head portion 400 may be adapted to connect with the additional lip 204 for establishing the connection between the cross beam and the filler beam assembly 100. In an embodiment, the head portion 400 may include a first slot 402 at one end and adapted to engage with the additional lip 204 of the filler beam assembly 100. On the opposite end, the head portion 400 may include a second slot 404 adapted to accommodate a timber runner.

Figure 5:
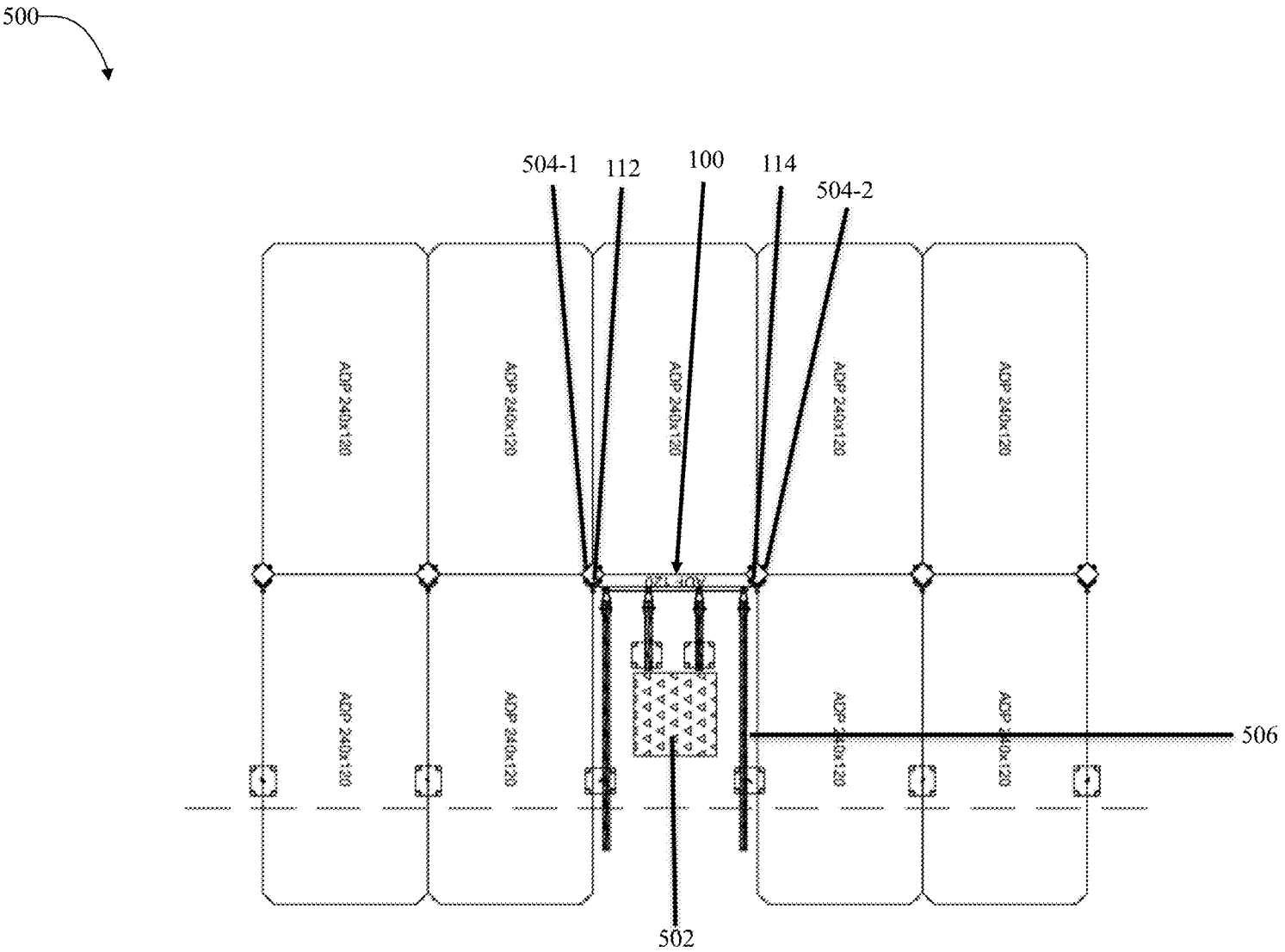
FIG. 5 illustrates a schematic top view of a formwork structure having the filler beam assembly, according to an embodiment of the present disclosure.
Figure 6:
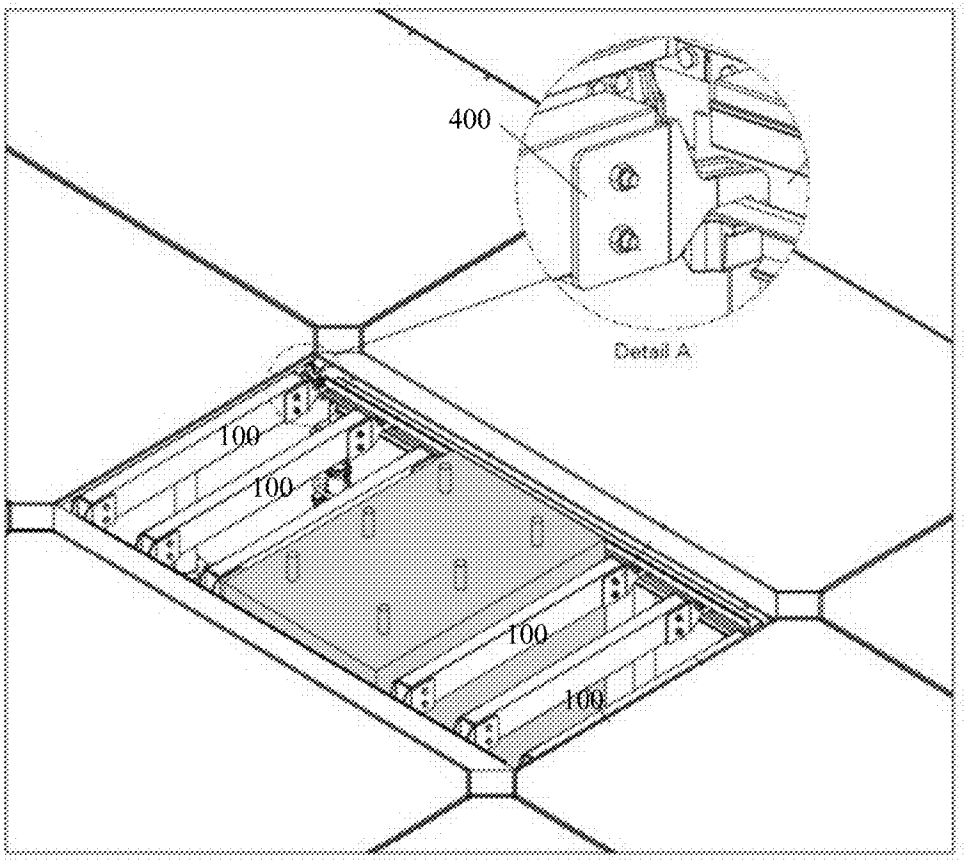
FIG. 6 illustrates a perspective view of the formwork structure depicting application of the filler beam assembly at column infill areas, according to an embodiment of the present disclosure.

FIG. 5 illustrates a schematic top view of a formwork structure 500 having the filler beam assembly 100, according to an embodiment of the present disclosure. FIG. 6 illustrates a perspective view of the formwork structure 500 depicting application of the filler beam assembly 100 at column infill areas, according to an embodiment of the present disclosure. Referring to FIG. 5 and FIG. 6, as illustrated, in order to provide infill solution around a column 502, the formwork structure 500 includes the filler beam assembly 100. The formwork structure 500 may also include drop-head assemblies having respective top plates 504 adapted to be in contact with one of the first end 102 and the second end 104 of the beam 101. In the illustrated embodiment, the drophead interface edge 112 and the drophead interface edge 114 of the top surface 110 are in contact with corresponding edges of the top plates 504, individually referred to as 504-1 and 504-2, of the drop-head assemblies. Further, a plurality of cross beams 506 is coupled with the filler beam assembly 100, for example, through the connection between the head portions 400 and the additional lip 204.

Figure 7:
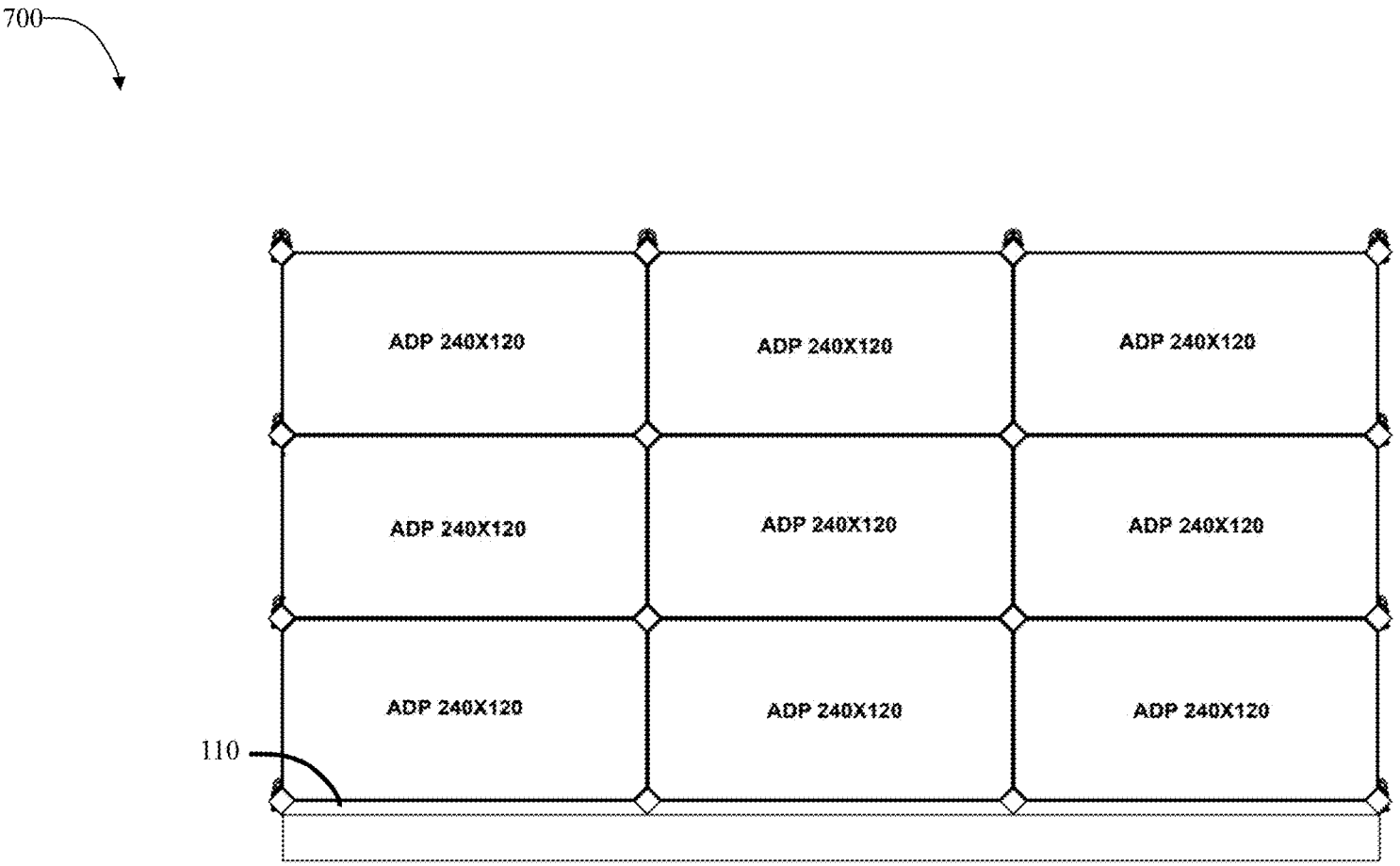
FIG. 7 illustrates another schematic top view of a formwork structure having the filler beam assembly, according to an embodiment of the present disclosure.
Figure 8:
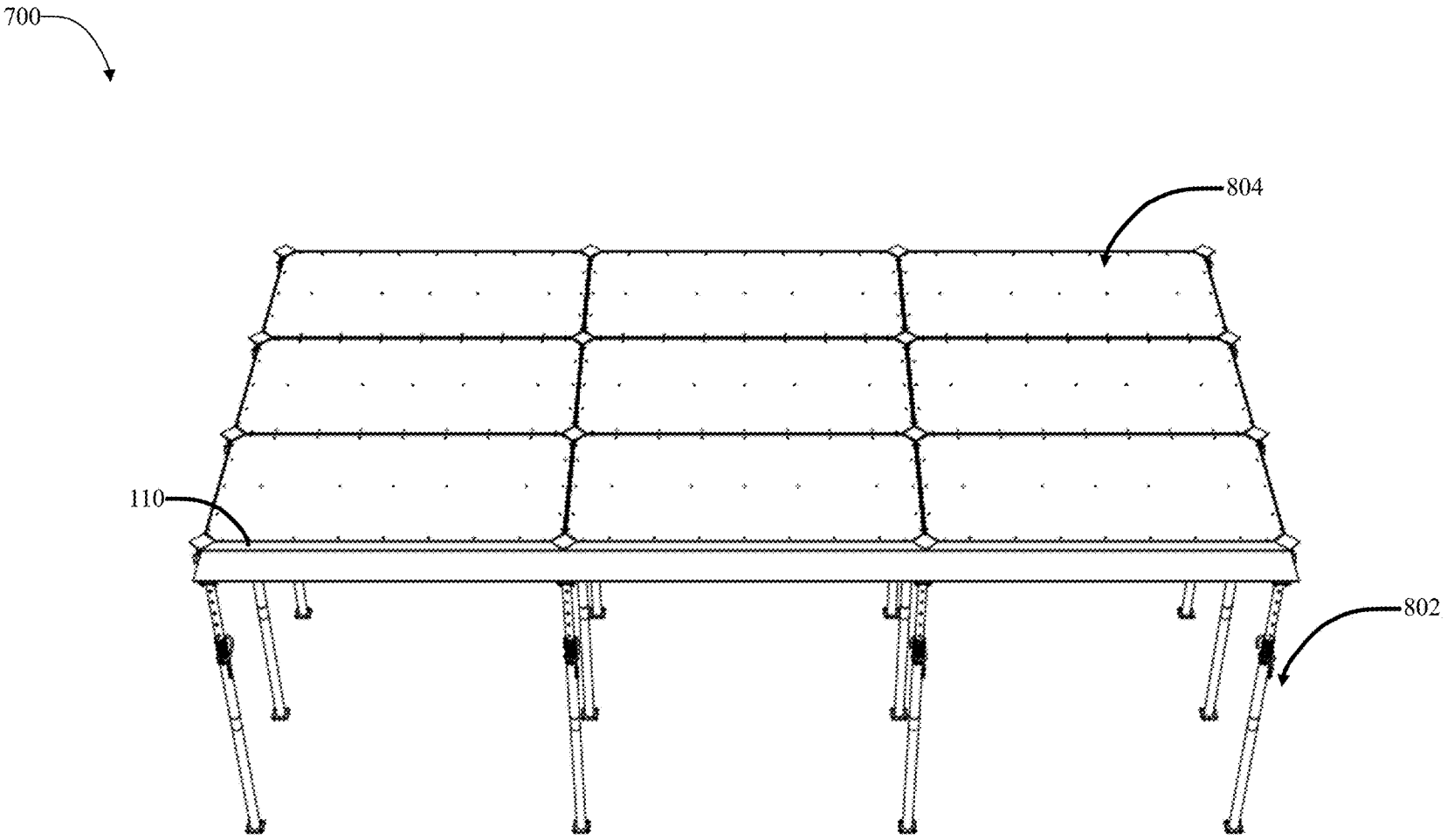
FIG. 8 illustrates a perspective view of the formwork structure having the filler beam assembly, according to an embodiment of the present disclosure.
Figure 9:
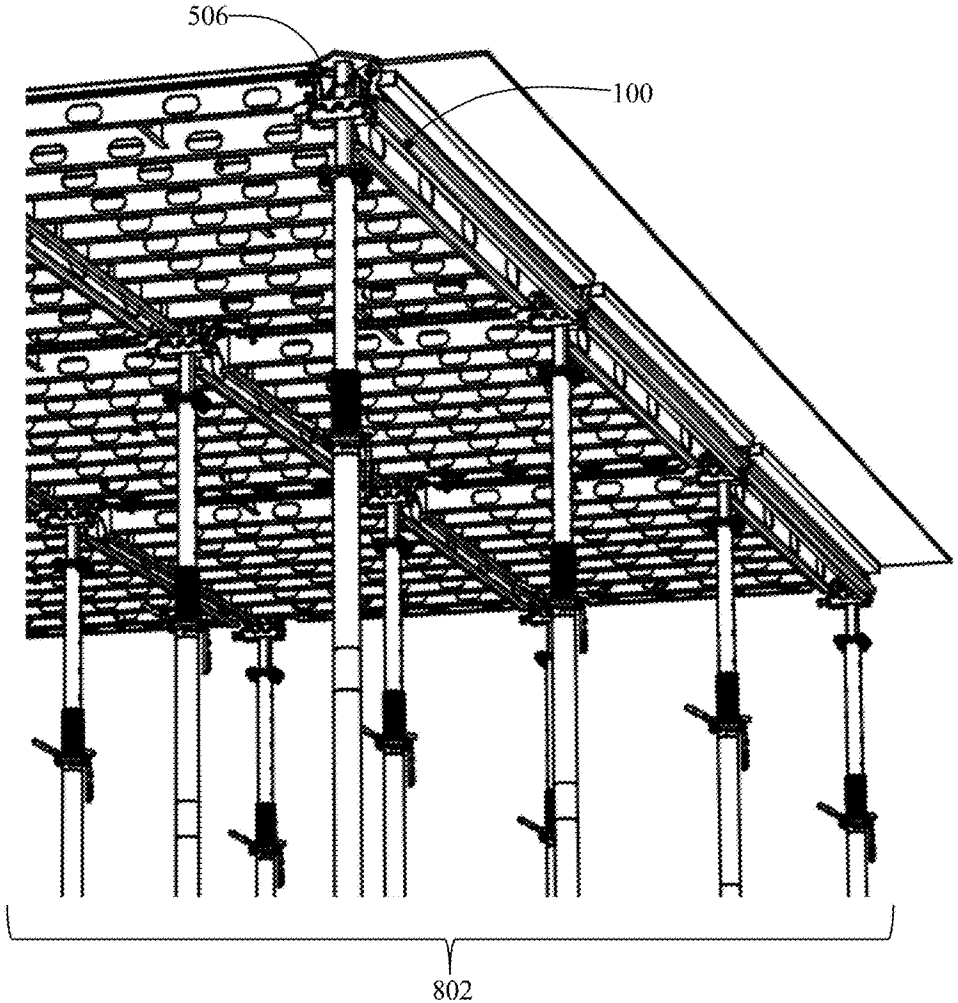
FIG. 9 illustrates a bottom perspective view of the formwork structure having the filler beam assembly, according to an embodiment of the present disclosure.
Figure 10:
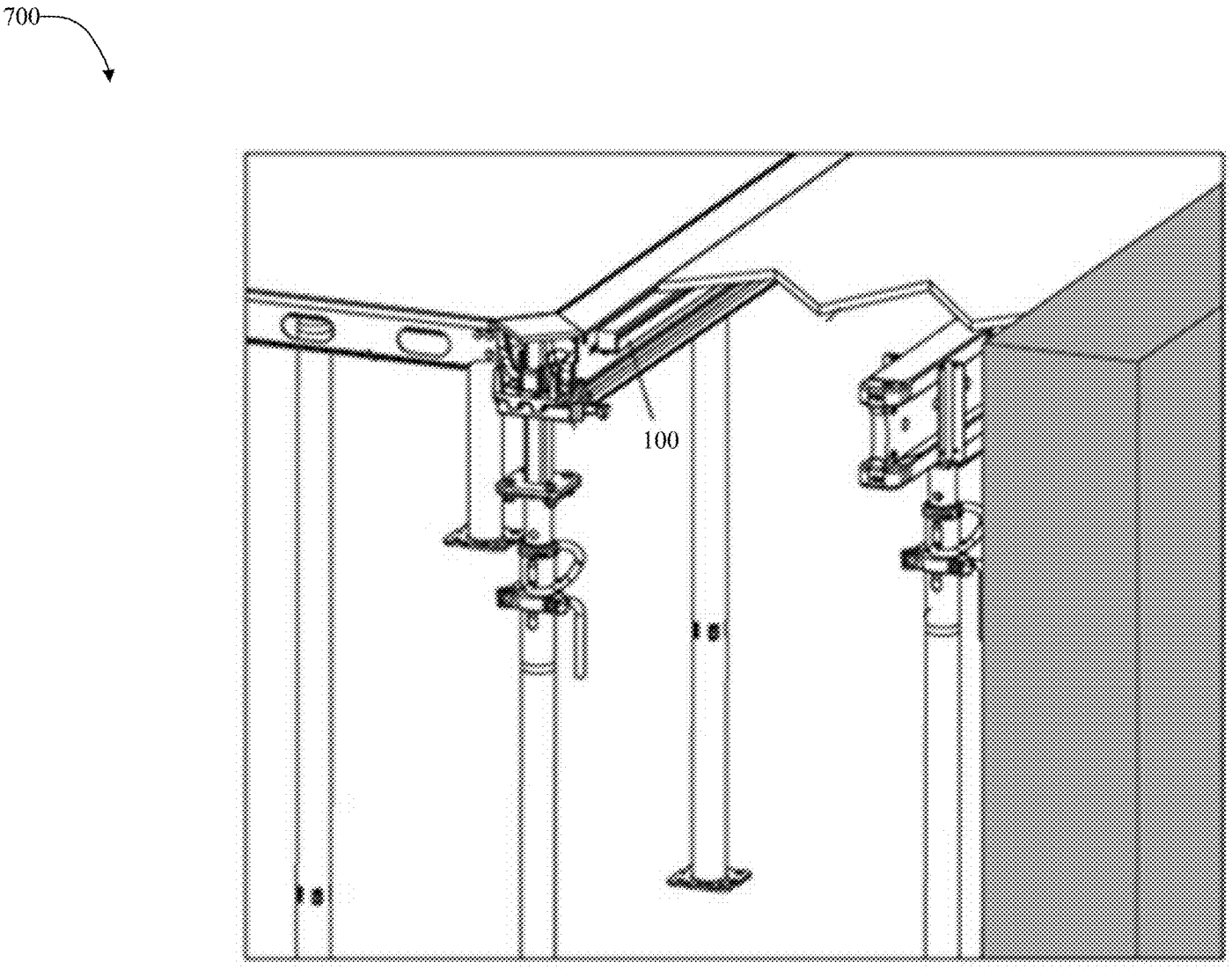
FIG. 10 illustrates a perspective view of the formwork structure depicting application of the filler beam assembly at infill areas, according to an embodiment of the present disclosure.

FIG. 7 illustrates another schematic top view of a formwork structure 700 having the filler beam assembly 100, according to an embodiment of the present disclosure. The formwork structure 700 is formed for compensation fills near walls or beams. FIG. 8 illustrates a perspective view of the formwork structure 700 having the filler beam assembly 100, according to an embodiment of the present disclosure. As shown in the present view, the drop-head assemblies 802 are supporting the filler beam assemblies 100, the cross beams 506, and plywood 804 forming the formwork structure 500. FIG. 9 illustrates a bottom perspective view of the formwork structure 700, according to an embodiment of the present disclosure. FIG. 10 illustrates a perspective view of the formwork structure 700 depicting application of the filler beam assembly 100 at infill areas, according to an embodiment of the present disclosure.

Further, the filler beam assembly 100 may be adapted to provide the infill solutions around columns, column capitals, drop beams, and adjacent to peripheral beams, without departing from the scope of the present disclosure.

Figure 11:
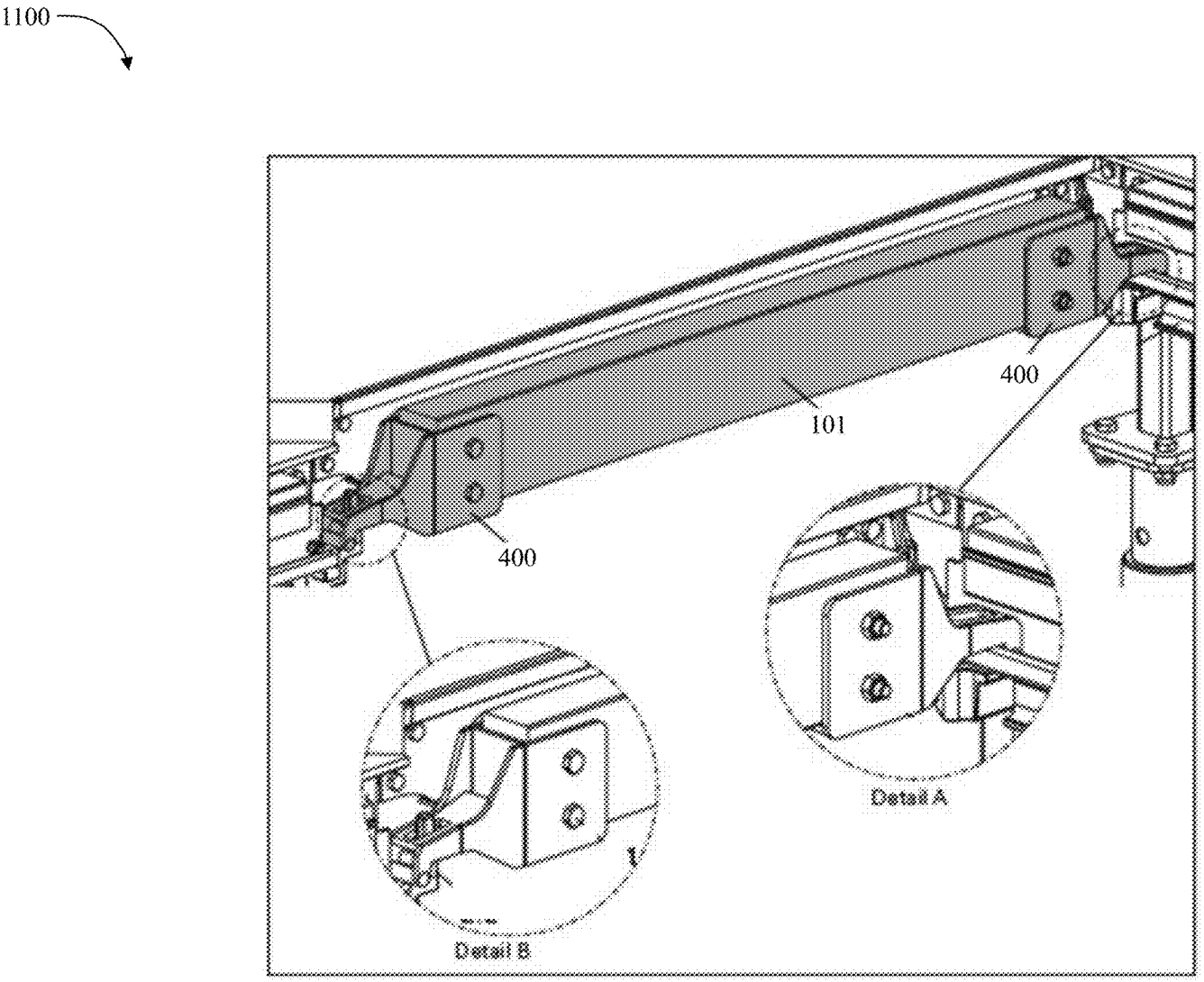
FIG. 11 illustrates a perspective view of a formwork structure depicting application of the filler beam assembly and a cross beam at internal corners of slab panels, according to an embodiment of the present disclosure.

FIG. 11 illustrates a perspective view of a formwork structure 1100 depicting application of the filler beam assembly 100 and a cross beam at internal corners of slab panels, according to an embodiment of the present disclosure.

As would be gathered, the filler beam assembly 100 of the present disclosure offer a comprehensive approach for construction of the structures, such as slabs especially the infill locations of slabs. Firstly, the provision of the first lip 202 and the additional lip 204 in the filler beam assembly 100 is suitable for accommodating an infill ply strip as well as a crossbeam assembly, respectively. As already explained, the first lip 202 and the additional lip 204 are adapted to accommodate the timber runner or the PU insert 300 and the crossbeam head portion 400, respectively, ensuring a large compensation area as well. The cavity created for the first lip 202 is adapted to accommodate different sizes of plywood, for example, up to a thickness of 26 mm on top of the timber or the PU insert 300. This is accomplished owing to the gap formed between the top surface of 110 and the first lip 202.

Further, the provision of the timber runner or the PU insert 300 on the filler beam assembly 100 facilitates convenient connection of the filler beam assembly 100 with conventional areas. Moreover, the first lip 202 allows for accommodating polymer or the timber 300 of different dimensions, for example, different timber insert sizes to suit various ply thickness used in different countries, such as 12 mm, 18 mm, and 21 mm.

Moreover, the provision of accommodating the cross beams on the filler beam assembly 100 allows for covering infill areas using the cross beams. In an embodiment, a cut may be provided on the first lip 202 for easy insertion of a cross beam head from the top, which occupies less space during shuttering and does not require any major angular insertion.

The existing filler beams usually provide a provision for timber/PU insert to nail plywood. In the present invention, the specially profiled bottom lip, i.e., the additional lip 204 of the filler beam assembly 100 makes it suitable not only for ply strip, but also serves as a primary member to be used for seating a cross beam head/cross direction timber runner, which ensures a larger compensation area.

Further, owing to the dimensional characteristics of the first end piece 106 and the second end piece 108, any possibility of toppling of the filler beam assembly 100 once coupled with the drop-head assembly is eliminated. Furthermore, the existing filler beam assemblies require cutting of supporting plywood to adjust to the shape of the top plate of the drop-head assembly. On the other hand, the filler beam assembly 100 of the present disclosure is provided with the drophead interface edges 112 and 114 to complement the shape of the top plate, without requiring any cutting of the supporting plywood. The profile of the drophead interface edges 112 and 114 may have a triangular profile, a circular profile, or a rectangular profile based on a profile of the corresponding edge of the top plate of the drop-head assembly. In an example, an angle of slant for the edge may be about 45°. Further, the edges of the filler beam assembly 100 may have a 90 mm top width with concrete contact surface, which would directly result in avoiding plywood corner cuts. Consequently, straight cutting of the plywood is sufficient for the assembly causing convenience to the user as well. Therefore, the filler beam assembly 100 of the present disclosure is effective, easy to install, flexible in implementation, cost-effective, convenient, and has a wide range of applications.

While specific language has been used to describe the present subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

We claim:

1. A filler beam assembly of a formwork structure, comprising:

a beam comprising:

a first end and a second end distal to the first end, wherein the first end and the second end are adapted to be in contact with top plates of respective drop head assemblies;

a first lip formed on one side of the beam and adapted to accommodate one of a timber runner or a Polyurethane (PU) insert;

an additional lip disposed below the first lip and adapted to accommodate a head portion of a cross beam;

a first end piece adapted to be disposed on an other side of the beam, wherein the other side is a side opposite to the one side having the first lip and the additional lip; and a second end piece adapted to be disposed on the other side of the beam and adjacent to the second end, wherein each of the first end piece and the second end piece are fastened to the other side of the beam by a screw-nut mechanism.

2. The filler beam assembly of claim 1, wherein the beam further comprises a top surface having a drop head interface edge at the first end and a drop head interface edge at the second end.

3. The filler beam assembly of claim 2, wherein one of the timber runner and the PU insert is nailed with a plywood positioned adjacent to the top surface of the beam.

4. The filler beam assembly of claim 1, wherein the beam is formed of one of an Aluminium extrusion of high-grade Aluminium alloy and of plate bent steel sections.

5. The filler beam assembly of claim 2, wherein each of the drop head interface edge at the first end and the drop head interface edge at the second end is formed to complement an interface edge of the top plate of the respective drop head assembly.

6. The filler beam assembly of claim 1, wherein the first lip and the additional lip are formed along the length of the beam.

7. The filler beam assembly of claim 1, wherein the first end piece is adapted to be disposed adjacent to the first end, and the first end piece and the second end piece are adapted to establish a connection with the respective drop head assemblies.

8. The filler beam assembly of claim 7, wherein each of the first end piece and the second end piece includes a slot that is adapted to be fixed to a fly-plate pin of the respective drop head assembly for establishing the connection with the respective drop head assembly.

9. A formwork structure comprising:

a filler beam assembly comprising:

a beam comprising:

a first end and a second end distal to the first end;

a first lip formed on one side of the beam and adapted to accommodate one of a timber runner or a Polyurethane (PU) insert;

an additional lip disposed below the first lip;

a first end piece adapted to be disposed on other side of the beam, wherein the other side is a side opposite to the one side having the first lip and the additional lip, and wherein the first end piece is fastened to the other side of the beam by a screw-nut mechanism; and a second end piece adapted to be disposed on the other side of the beam and adjacent to the second end, wherein each of the first end piece and the second end piece are fastened to the other side of the beam by the screw-nut mechanism; and a drop head assembly comprising a top plate adapted to be in contact with one of the first end and the second end of the beam, the top plate comprising an interface edge to be in contact with a respective drop head interface edge, wherein the drop head interface edge is formed to complement the interface edge of the top plate.

10. The formwork structure of claim 9, wherein the beam further comprises a top surface having the drop head interface edge at the first end and the drop head interface edge at the second end.

11. The formwork structure of claim 10, wherein one of the timber runner and the PU insert is nailed with a plywood positioned adjacent to the top surface of the beam.

12. The formwork structure of claim 9, further comprising a cross beam adapted to couple with the filler beam assembly and having a head portion, wherein the head portion is adapted to connect with the additional lip to establish a connection between the cross beam and the filler beam assembly.

13. The formwork structure of claim 12, wherein the head portion comprises:

a first slot at one end and adapted to engage with the additional lip; and a second slot disposed at the opposite end and adapted to accommodate a timber runner.

* * * * *